US005658422A

United States Patent [19]

Boss et al.

[11] Patent Number: 5,658,422

[45] Date of Patent: Aug. 19, 1997

[54] DEVICE FOR FEEDING A MACHINE WHICH PROCESSES PRINTED SHEETS

[75] Inventors: Heinz Boss, Strengelbach; Ernst Lüthi, Brittnau, both of Switzerland

[73] Assignee: Grapha-Holding AG, Hergiswil, Switzerland

[21] Appl. No.: 357,226

[22] Filed: Dec. 12, 1994

[30] Foreign Application Priority Data

Dec. 10, 1993 [CH] Switzerland ..... CH-03 681/93-5

[51] Int. Cl.[6] ..... B65H 39/00

[52] U.S. Cl. ..... 156/556; 156/566; 156/568; 156/571; 270/52.19

[58] Field of Search ..... 156/556, 566, 156/567, 568, 570, 571, 364; 270/52.19

[56] References Cited

U.S. PATENT DOCUMENTS

| | | | |
|---|---|---|---|
| Re. 31,710 | 10/1984 | Jackson . | |
| 5,116,452 | 5/1992 | Eder | 156/567 X |
| 5,169,489 | 12/1992 | Kalisiak et al. | 156/555 |
| 5,275,685 | 1/1994 | Stauber | 156/556 |

FOREIGN PATENT DOCUMENTS

| | | |
|---|---|---|
| 0332828 | 9/1989 | European Pat. Off. . |
| 0472900 | 3/1992 | European Pat. Off. . |
| 0540865 | 5/1993 | European Pat. Off. . |

*Primary Examiner*—James Engel
*Attorney, Agent, or Firm*—Spencer & Frank

[57] ABSTRACT

A device for processing printed sheets and for feeding processed printed sheets to a machine for further processing the processed printed sheets. The device includes a feeder for separating the printed sheets from a stack of printed sheets and for conveying the printed sheets. The device also includes a conveying device disposed downstream of the feeder for conveying the printed sheets to the machine, and a conveying element disposed between the feeder and the conveying device for conveying and processing the printed sheets. The conveying element is driven to convey the printed sheets in a similar conveying direction and at a similar clock pulse as the feeder and the conveying device. The conveying element further includes carriers for transferring the printed sheets away from the feeder and for conveying the printed sheets; an inlet region disposed adjacent the feeder for receiving the printed sheets transferred away from the feeder by the carriers; an effective conveying region disposed adjacent the carriers and cooperating therewith for conveying the printed sheets; and processing means disposed adjacent the conveying region and including at least one of an insert feeding device and an imprinting device for processing the printed sheets thereby forming processed printed sheets.

14 Claims, 1 Drawing Sheet

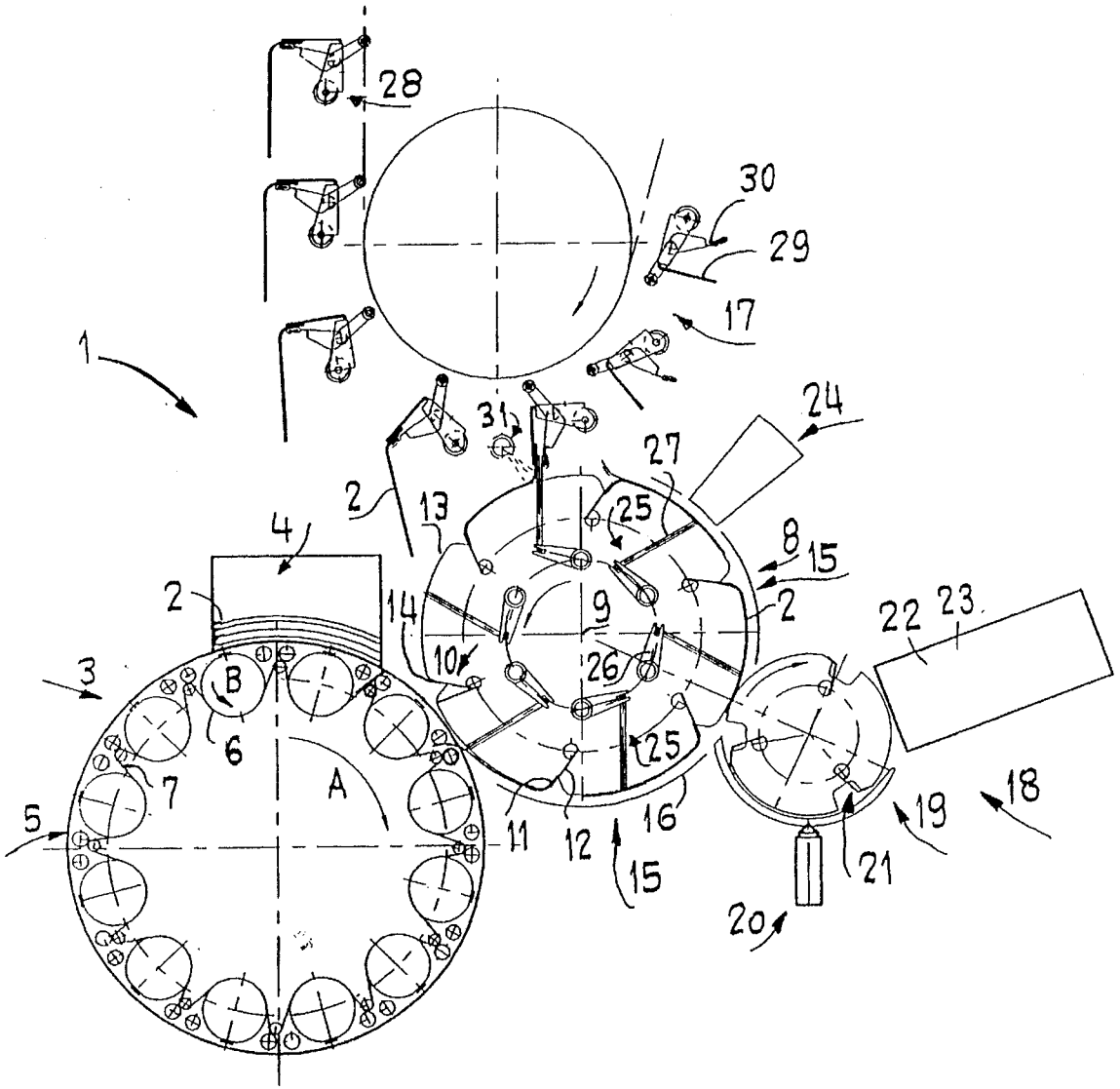
1
2
3
4
5
6
7
8
9
10
11
12
13
14
15
16
17
18
19
20
21
22
23
24
25
26
27
28
29
30
31
A
B

DEVICE FOR FEEDING A MACHINE WHICH PROCESSES PRINTED SHEETS

CROSS-REFERENCE TO RELATED APPLICATION

This application claims the priority of patent application Ser. No. CH 03681/93-5 filed Dec. 10, 1993, in Switzerland, the subject matter of which is incorporated herein by reference.

BACKGROUND OF THE INVENTION

The invention relates to a device for feeding a machine that processes printed sheets such as a gather-stitcher, an inserting machine or an assembling machine. The said device includes a feeder that separates the printed sheets from a stack, and a conveying arrangement which is disposed downstream of the feeder and which communicates with the processing machine.

During the production of printed products such as periodicals, newspapers, brochures, etc., with the aforementioned machines, cards are also attached and/or the printed products are addressed by means of an inscription.

The inscription of the separated printed sheets takes place, for example, in a device according to EP-A-0 472 900, in a horizontal line section of a conveyor which has received the printed sheets from a feeder drum. In the horizontal line section, the printed sheets, lying flat, move past an ink jet apparatus which is arranged over the line section and, under clock control, the sheets are then fed in astride position, to a gathering line of a gather-stitcher by means of a feeder having an opening arrangement. Owing to the fact that, following a conveyor loop, the horizontal line section is adjoined by a second one, the printed sheets can be inscribed alternatively on both sides.

In a known arrangement for the gluing of inserts to printed products according to EP-A-0 540 865, a gluing device is provided with a plurality of supporting arms seated at a circulating element, with the arms having holders at their free ends. The holders receive one insert each at a delivery point, move the inserts past an adhesive applicator device, where adhesive is applied to the inserts, and advance the inserts to the printed products where the inserts are glued to the printed products. The printed products are conveyed while resting against supports that are extending transversely to the direction of conveyance, and the holders are respectively dipped in between two subsequent supports and are moved against the supports with the assistance of the control means so as to glue and press the inserts to the printed products.

Both known arrangements lack one of the options of imprinting the printed products or feeding inserts to them during processing.

It is thus the object of the present invention to create a device that allows a simple pass-through of the printed products as well as universal application given the processing principles mentioned above, and, alternatively, the attachment of inserts by gluing and/or addressing by imprinting. This is intended to be made possible without any special provisions. In addition, the device according to the invention is intended to be usable for the afore-mentioned processing purposes without the options of selectively feeding inserts and/or imprinting addresses.

SUMMARY OF THE INVENTION

The above object is solved by the invention in that, between the feeder and the conveying arrangement configured as a conveyor, a conveying element having carriers that can be actuated is arranged which, at an inlet region thereof, is circulatingly driven approximately in the same direction and at the same clock pulse as the feeder and the conveying arrangement, with an insert feeding arrangement and/or an imprinting arrangement, which can be connected alternatively, cooperating with the effective conveying region of the conveying element, wherein the conveying element could be configured to circulate around an axis. The conveying element could, for example, be drum-shaped, or be shaped as a pulling means circulating around a plurality of several parallel axes and being provided with gripper tongs or the like. In the second option, which is not described in detail as an embodiment, the gripper tongs respectively connected to the upper track of the circulating pulling means could be fed by a feeder that separates the printed sheets, with, along the further conveying path to the conveying arrangement, an insert being glued to the printed sheets in a horizontal position and/or the printed sheets being imprinted by a printer.

In a device that proves to be particularly advantageous, the printed sheets are fed, folded edges first, to a conveying drum having an axis that is perpendicular to the direction of conveyance; at the inlet region, that is, at the effective conveying periphery of the conveying drum, uniformly spaced, controllable gripping elements, together with a conveyor, cooperate with the folded edges of the fed printed sheets for conveying the same in a downstream direction, and the printed sheets are guided while resting against the conveyor at least for the duration of the processing or until further transfer.

Such an embodiment is suited for a compact method of construction usable in tight spaces.

For the stabilization of the printed sheets in the conveying region, it is advisable for the conveying drum to be associated with a conveying arrangement facing the drum, thus ensuring a precise attachment of inserts and/or addresses.

For the removal of the printed sheets from the conveying drum with the participation of the conveyor, a push-off arrangement is provided preferably effective in the inlet region or transfer/delivery region to the conveying arrangement, controllably lifting the printed sheets at one end thereof off of the periphery of the conveying drum and cooperating with the gripper tongs of the conveyor, which places the lifted end of a printed sheet into the gripper tongs that are still open.

The proposed embodiment of the push-off device allows for, alternatively, either the trailing end or the leading end of the printed sheets to be lifted off of the conveying drum into the removal position so that it can protrude into the open gripper tongs.

These and other features and advantages of the invention will be further understood from the following detailed description of the preferred exemplary embodiment with reference to a sole accompanying drawing.

BRIEF DESCRIPTION OF THE DRAWING

The sole FIGURE is a schematic illustration of a device according to the present invention.

DESCRIPTION OF THE PREFERRED EMBODIMENT

A device 1 for feeding a machine that processes printed sheets 2 such as a gather-stitcher for periodicals, an inserting machine for newspapers or an assembling machine for brochures and books or the like (not shown) consists of a feeder 3 that pulls the printed sheets 2 stacked on top of each other in a magazine 4 off the bottom of the formed stack.

For this purpose, a rotor 5 is provided below the stack, said rotor consisting of a plurality of pull-off rollers 6 distributed over its periphery, which separate the lowest printed sheet 2 at the closed folded edge thereof by means of a vacuum suction device (not shown) and guide it between pull-off rollers 6 and a belt 7, which partially wraps around the pull-off rollers. The rollers respectively roll over the printed sheet 2 and push it out of the rotor 5 after the rotor has rotated by approximately 90°. The arrows A and B designate the direction of rotation of the rotor 5 and the pull-off rollers 6, respectively.

A conveying element configured as a conveying drum 8 has an inlet region which adjoins the conveying end of the feeder 3, and which moves in approximately the same direction as the conveying end of the feeder 3. Here, the printed sheets 2 are fed, starting from the closed folded edges thereof, to the conveying drum 8. Conveying drum 8 includes a rotational axis 9.

Distributed over its periphery, the conveying drum 8 is provided with gripping elements 10 that are controlled in such a manner that they are open in the inlet region towards the conveying end of feeder 3 until the time of arrival of the printed sheet 2 and, immediately afterwards, seize the printed sheet at the leading end—here, the closed folded edge—by closing thereupon. For the above purpose, the gripping elements 10 are configured so as to cooperate with a recess at the drum periphery, i.e., the gripping elements are configured to be tong-like and are provided with a stationary clamping part 11 and a movable clamping part 12. The stationary clamping part 11 is formed by a respective stopping face 14 that is angled inwardly and adjoins the shell sections 13 of the conveying drum 8, while the movable clamping part 12 can be swiveled.

In the opened state of the gripping element 10, both clamping parts 11 and 12 form a tapering guide for the printed sheet 2 being fed thereto. The closing motion takes place, for example, through a cam (not shown) acting upon the movable clamping part 12.

Following the conveyance or transfer, the printed sheet 2 is guided through an undershot conveying channel extending along the periphery of the conveying drum 8, the channel being formed by a guiding arrangement 15. In the present case, the latter consists of at least one stationary guide element 16 which partially surrounds the conveying drum 8 in the conveying region. Instead, a continuous guide belt could also be used, partially wrapping around the conveying drum 8 and circulating around a plurality of rolls. A guide belt would have to be driven by a motor or by the conveying drum 8. The downstream end of the guide arrangement 15 is disposed in the transfer region or inlet region of a conveying arrangement 17 which communicates with the processing machines.

An insert feeding arrangement 18, which can be added, is associated with the conveying region of the printed sheets 2 at the conveying drum 8. The present embodiment represents a so-called card gluer which is provided with a feeder 19 for printed products that are smaller in size than the printed sheets, e.g., cards, bags or the like, which, on their way toward the printed sheets 2, pass through a glue applicator station 20. Inserts 23 are first pulled off from the front side or underside of a stack 22 by a circulating gripping drum 21 and, during this process, pass through the glue applicator station 20 where an adhesive strip is applied to them. Thereafter, inserts 23 are rolled down on the printed sheets 2 that are resting against the conveying drum 8.

Along the further conveying path, the printed sheets 2, with or without inserts 23, move past an imprinting arrangement 24, where they can be provided with an inscription, such as an address.

Now the printed sheets 2 are ready for further processing and can be carried away by the conveying drum 8.

For the above purpose, an outwardly acting push-off arrangement 25 is provided within the conveying drum 8, which cooperates with the cylindrical surface sections 13 of the individual printed sheets 2. The free end of a lever arm 26 actuatable by a cam (not shown) is connected to a plunger arrangement 27 which can be pushed out over the periphery of the conveying drum 8, thus pushing off the printed sheet 2 resting against the corresponding cylindrical surface section 13 at the trailing end thereof in the direction of conveyance, such that the trailing end can be seized by the approaching opened gripper tongs 28 of the conveying arrangement 17 configured as a conveyor.

The sole FIGURE shows the gripper tongs 28 before and after the printed sheets 2 are seized off the conveying drum 8. At the time of being seized off, the printed sheets 2, with their trailing end, are clamped into the gripper tongs 28 and are released from the conveying drum 8 by means of the opening of the gripping elements 10.

To support the reception of the printed sheets 2 by means of the gripper tongs 28, a counter-supporting arrangement 31 can be provided which acts on the printed sheets 2 against the conveying drum 8 from an outer surface of the printed sheets so as to promote the tilting upward or folded edge of each end of the printed sheet by the plunger arrangement 27. The above can achieved by the action of compressed air, bristles or other mechanical elements.

The gripper tongs 28 may be configured such that the leading part 29 of the gripper tongs 28 is rigid while the trailing part 30 of the gripper tongs is movable.

As is illustrated in the FIGURE, the rigid part 29 of the gripper tongs 29 could be configured in such a way that the free end extends against the periphery of the conveying drum 8 in the inlet region towards the conveying drum and forms a folded edge for the end of the printed sheet. Functionally, the above arrangement means that the push-off arrangement 25 becomes active when the rigid part of the gripper tongs 29 has passed over the outlet position of the plunger arrangement 27 at the periphery of the conveying drum 8 relative to the direction of conveyance. The plunger arrangement 27, by being driven beyond the periphery of the conveying drum 8, tilts the end of the printed sheet towards the rigid part 29 of the gripper tongs so that it protrudes beyond the plunger arrangement 27 and is clamped by the movable part of the gripper tongs, which closes the gripper tongs 28.

To ensure that the ends of different formats of printed sheets can be tilted upward from the cylindrical surface sections 13 by means of the same push-off arrangement 25, the push-off arrangement 25 is adjustably configured along the periphery relative to the length of the cylindrical surface sections 13. For the above purpose, the push-off arrangement 25 is secured to a support (not shown) which is arranged concentrically relative to the conveying drum 8, and which is angularly displaceable with respect to the latter.

It is, of course, possible to also lift the printed sheets 2 off of the conveying drum 8 at their leading end, as needed, in a similar fashion.

It will be understood that the above description of the present invention is susceptible to various modifications, changes and adaptations, and the same are intended to be comprehended within the meaning and range of equivalents of the appended claims.

What is claimed is:

1. A device for processing printed sheets and for feeding processed printed sheets in a conveying direction to a machine for further processing the processed printed sheets, comprising:

a feeder for separating the printed sheets from a stack of printed sheets and for conveying the printed sheets;

a conveying device disposed downstream of the feeder, as viewed in the conveying direction, for conveying the printed sheets to the machine, the conveying device including a plurality of gripper tongs thereon for gripping a lifted off trailing end of the printed sheets; and a conveying element comprising a rotatable conveying drum disposed between the feeder and the conveying device for conveying and processing the printed sheets, the conveying drum being driven to convey the printed sheets in a similar conveying direction and at a similar clock pulse as the feeder and the conveying device, the conveying drum further having a rotational axis perpendicular to the conveying direction and including:

carriers comprising controllable gripping elements cooperating with folded edges of the printed sheets for transferring the printed sheets away from the feeder and for conveying the printed sheets;

an inlet region disposed adjacent the feeder for receiving the printed sheets transferred away from the feeder by the gripping elements;

an effective conveying region comprising a conveying periphery of the conveying drum disposed adjacent the gripping elements and cooperating therewith for conveying the printed sheets, wherein:

the printed sheets are conveyed, downstream of the inlet region, while resting flatly against the conveying periphery;

the gripping elements are uniformly spaced about the conveying periphery; and the gripper tongs of the conveying device are effective for transferring the printed sheets away from the conveying drum;

processing means disposed adjacent the conveying periphery and including at least one of an insert feeding device and an imprinting device for processing the printed sheets thereby forming processed printed sheets;

a transfer region disposed adjacent the conveying device for allowing a transfer of printed sheets away from the conveying drum to the conveying device; and a push-off device effective at the transfer region for controllably lifting the printed sheets at a trailing end thereof off of the conveying periphery of the conveying drum toward the conveying device.

2. The device according to claim 1, wherein the conveying drum further includes a guiding device disposed downstream of the inlet region for guiding a conveyance of the printed sheets.

3. The device according to claim 1, wherein the conveying drum further includes a counter-supporting device disposed adjacent the conveying device at the conveying periphery of the conveying drum for supporting a lift-off of the trailing end of each printed sheet by acting against the conveying periphery in a front region of the lifted off trailing end.

4. The device according to claim 2, wherein the guiding device includes an undershot channel at the conveying periphery of the conveying drum.

5. The device according to claim 3, wherein the push-off device includes a plurality of plunger devices nested within the conveying drum, each of the plunger devices having, at one end thereof, a push-off tip adapted to rest below the conveying periphery against a bottom region of the trailing end of each printed sheet, and, at another end thereof, a lever operatively connected to the push-off tip for displacing the push-off tip, in the transfer region of the conveying drum, to protrude above the conveying periphery for lifting off the trailing edge of an associated printed sheet.

6. The device according to claim 2, wherein the guide device includes at least one guide belt surrounding the conveying periphery over at least a length thereof and being driven to convey the printed sheets in a similar conveying direction and at a similar clock pulse as the conveying drum.

7. The device according to claim 2, wherein the guide device includes a stationary guide element disposed adjacent the conveying periphery at a distance therefrom.

8. The device according to claim 5, wherein:

the conveying drum further includes a plurality of guide belts disposed downstream of the inlet region for guiding a conveyance of the printed sheets; and the push-off tip is adapted to protrude above the conveying periphery between two of the guide belts.

9. The device according to claim 1, wherein the insert feeding device includes an insert feeder and a gluing means disposed adjacent the insert feeder for supplying glue to inserts for gluing the inserts to the printed sheets.

10. The device according to claim 9, wherein the insert feeder includes a feeder drum for gluing the inserts to the printed sheets by rolling down against the printed sheets resting flatly against the conveying periphery of the conveying drum.

11. The device according to claim 10, wherein the gluing means is a glue applicator disposed along a conveyance path of the insert feeder.

12. The device according to claim 1, wherein the conveying drum further includes a support disposed concentrically with respect to the rotational axis and being angularly displaceable with respect to the conveying periphery, the push-off device further being secured to the support.

13. The device according to claim 1, wherein each of the gripper tongs includes a rigid leading part and a movable trailing part disposed adjacent the rigid leading part for cooperating therewith, the gripper tongs being adapted to extend toward the transfer region of the conveying drum.

14. The device according to claim 13, wherein the rigid leading part forms an edge for cooperating With the push-off tip of the plunger device for transferring the printed sheets away from the conveying drum to the conveying device.

* * * * *